US006520067B1

(12) United States Patent
Hunt et al.

(10) Patent No.: US 6,520,067 B1
(45) Date of Patent: Feb. 18, 2003

(54) HYDRAULIC PISTON LOCKING DEVICE

(76) Inventors: Michael H. Hunt, 1700 2nd Ave. E., Tampa, FL (US) 33605; Preston E. Smith, 1700 2nd Ave. E., Tampa, FL (US) 33605

( * ) Notice: Subject to any disclaimer, the term of this patent is extended or adjusted under 35 U.S.C. 154(b) by 0 days.

(21) Appl. No.: 09/683,309

(22) Filed: Dec. 12, 2001

(51) Int. Cl.[7] ..... F15B 15/26
(52) U.S. Cl. ..... 92/23; 70/423; 180/287
(58) Field of Search ..... 92/15, 17, 23; 70/174, 423; 212/304; 180/287; 280/764.1

(56) References Cited

U.S. PATENT DOCUMENTS

| | | | | |
|---|---|---|---|---|
| 2,397,516 A | | 4/1946 | Stewart | |
| 3,135,555 A | | 6/1964 | Caskey | |
| 3,554,094 A | | 1/1971 | Gross | |
| 4,043,253 A | | 8/1977 | Albright et al. | |
| 4,122,758 A | | 10/1978 | Bieringer et al. | |
| 4,373,851 A | * | 2/1983 | Confoey | 92/23 |
| 4,417,644 A | | 11/1983 | Brogard | |
| 4,483,564 A | | 11/1984 | McDaniel | |
| 4,557,470 A | | 12/1985 | Link | |
| 4,791,855 A | | 12/1988 | Matsui | |
| 4,913,254 A | * | 4/1990 | Castro et al. | 180/287 |
| 4,947,705 A | | 8/1990 | Yates et al. | |
| 4,949,661 A | | 8/1990 | Phillips et al. | |
| 4,951,552 A | | 8/1990 | Fox | |
| 4,981,069 A | | 1/1991 | Matsui | |
| 5,024,303 A | | 6/1991 | Kosloff | |
| 5,199,344 A | | 4/1993 | Wagner et al. | |
| 5,492,206 A | | 2/1996 | Shieh | |
| 5,983,684 A | | 11/1999 | Boisvert | |
| 6,273,405 B2 | | 8/2001 | Okamoto | |
| 6,405,570 B1 | * | 6/2002 | Middleton et al. | 70/174 |

* cited by examiner

*Primary Examiner*—Edward K. Look
*Assistant Examiner*—Thomas E. Lazo
(74) *Attorney, Agent, or Firm*—Anton J. Hopen; Smith & Hopen, P.A.

(57) ABSTRACT

A device for locking a piston rod of a hydraulic piston and cylinder assembly in an extended condition. The locking device is placed in interposed relation to a hydraulic cylinder and an opposing bearing point to prevent retraction of the piston rod. The device has a split sleeve configuration to facilitate mounting the locking device in encircling relating to the piston rod including opposed longitudinally extending edges that are locked to one another via a locking means. The locking means of the device is partially enclosed by a lock protecting housing to protect the locking device from being removed by unauthorized persons. The device is durable, easy to install and remove, and adaptable to a variety of hydraulic piston and cylinder assemblies.

6 Claims, 3 Drawing Sheets

HYDRAULIC PISTON LOCKING DEVICE

BACKGROUND OF THE INVENTION

1. Field of the Invention

This invention relates, generally, to locking devices and more particularly to means for locking a hydraulic piston rod in an extended condition.

2. Description of the Prior Art

Heavy machinery such as bulldozers and backhoes often remain on the job site throughout the course of a construction project because the effort to transport the equipment to a secure site is expensive and time-consuming. The heavy machinery may be left on a job site for several days. The machinery is relatively unlocked and susceptible to theft and vandalism.

Buckets, blades and like attachments of heavy machinery operate using hydraulic cylinder and piston rod assemblies. The piston rod is retracted and extended from the cylinder using hydraulic pressure. During maintenance, a steel sleeve is commonly interposed between the connection point, or bearing, of the rod and the cylinder opening encircling the exposed piston rod. This supports the rod in an extended position so that in the event of loss of hydraulic pressure the rod will not uncontrollably retract within the cylinder thereby preventing undesirable movement of the attachment.

A sleeve can also be used as a locking device. The locking sleeve is similarly placed over the exposed piston rod as in maintenance use but the sleeve is also locked into place using a padlock. This will prevent the sleeve from being removed and thus secure the rod in an extended condition. With the rod in an extended position the attachments can be fixed in either a lowered or raised position making the unauthorized movement of the heavy machinery more difficult.

Prior art hydraulic locking devices include U.S. Pat. No. 4,373,851 to Confoey that describes a split cylindrical sleeve that encloses around the piston rod and includes extended tabs that are locked together using a padlock to prevent removal. The Confoey configuration is susceptible to having the padlock cut off using bolt cutters or broken off using extreme force. It would be desirable if a more secure locking system could be provided to protect against theft and vandalism.

In summary, the needed improvements include a locking device that is easy to install and remove which is also durable and protects against theft and vandalism.

However, in view of the prior art considered as a whole at the time the present invention was made, it was not obvious to those of ordinary skill in the pertinent art how the identified needs could be fulfilled.

SUMMARY OF INVENTION

The long standing but heretofore unfulfilled need for a locking device for heavy machinery that can be used at unsecured construction sites or storage areas, which can be installed and removed easily, and which is durable, is now provided in the form of a new, useful and non-obvious device.

The novel structure includes a substantially rigid sleeve consisting of a pair of sleeve halves having diametrically opposite longitudinally extending meeting edges wherein said sleeve halves are hingedly connected along a first meeting edge via a hinge means so that said sleeve halves are openable for mounting on an extended piston rod. A locking means is disposed between said sleeve halves at a second opposing longitudinal extending meeting edge for releasably securing said sleeve halves to one another wherein said sleeve is adapted to fit snugly around said piston rod in encircling relation thereto. A half circle portion of an annular flange is disposed on a first end of each of said sleeve halves wherein the diameter of said annular flange is greater than the diameter of a cylinder of said hydraulic cylinder and piston assembly. A half portion of a lock protecting housing is disposed adjacently and in mirrored relation on each of said pair of sleeve halves so that a locking means can be enclosed therein when said sleeve is mounted on said piston rod. An apertured lug extends from and is secured to each of said sleeve halves within said lock protecting housing wherein each said lug is apertured for receiving a locking pin therethrough and said locking pin is releasably secured using said key. An overlying reinforcing band is disposed proximate to a second end of each of said sleeve halves so that stress loads concentrated at said second end are dissipated.

In a preferred embodiment, a commercially available shackleless locking means with a hidden pin assembly secures the sleeve halves to one another.

In a second embodiment, the locking device includes a standard sleeve half that is secured over the extended piston rod with a pin and bracket assembly. The pin and bracket assembly is placed between the transversely spaced first wall and second wall of the sleeve half member so that the extended rod is interposed between the channel-shaped member and the pin and bracket assembly. A similar shackleless locking means as in the first embodiment secures one end of the bracket within the lock so that the pin and bracket assembly cannot be removed from the sleeve half member thereby preventing removal of the sleeve from the extended piston rod.

An important object of the present invention is to provide an improved locking device, for use with heavy machinery that prevents the movement of a hydraulic piston rod and prevents the theft of the machinery.

Another object is to provide a means for attaching the locking device in its proper, functional location without undue effort so that the locking device may be easily installed and removed as needed.

Another object is to provide a locking device suitable for several different heavy machines without modification and which is durable and can withstand unauthorized removal attempts.

These and other important objects, advantages, and features of the invention will become clear as this description proceeds.

It is to be understood that both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
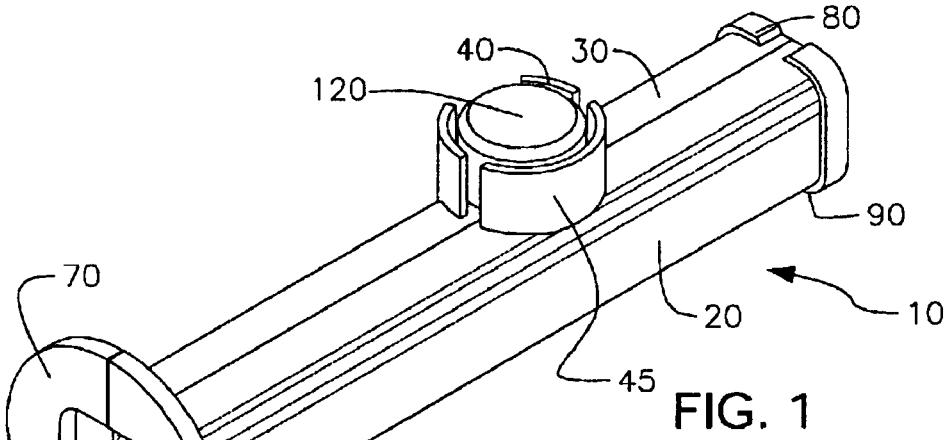
FIG. 1 is a perspective view of a first embodiment of the locking device of the present invention in a closed position.
Figure 2:
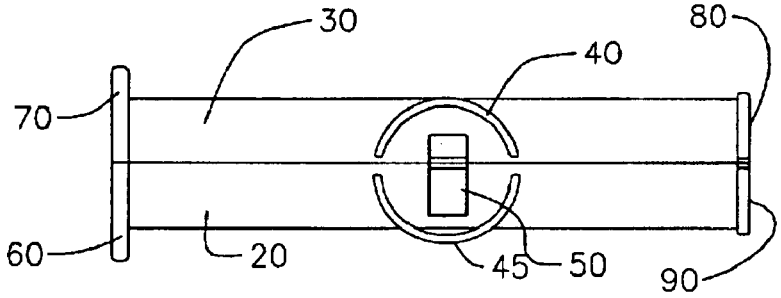
FIG. 2 is a top view of a first embodiment of the locking device of the present invention in a closed position.

Referring now to FIGS. 1 and 2, it will there be seen that the reference numeral 10 denotes a first embodiment of the novel locking device as a whole. Device 10 will be known commercially as the SleevLock™.

In this first embodiment, locking device 10 includes a first sleeve half 20 and a second sleeve half 30 each having a channel shape with a longitudinally disposed hinge 100 therebetween. Half circle portions 60 and 70 are disposed on a first end of each of the sleeve halves 20 and 30, respectively, forming an annular flange of a diameter greater than the diameter of a hydraulic cylinder housing of heavy machinery. Reinforcing bands 80 and 90 are attached proximate to a second end of each sleeve half, 30 and 20 respectively, thereby providing additional structural strength for supporting high stress loads concentrated at the interface between locking means 10 and the bearing point. An annular housing for protecting a locking means is disposed opposite said hinge 100 as seen in FIGS. 1 and 2 of the drawings and denoted 40 and 45. An apertured lug 50 extends from and is secured to each of said sleeve halves 20 and 30 within the cylindrical housing. Lug 50 is apertured for placement of a locking means therethrough. Half cylindrical portions 40 and 45 form said annular housing wherein each of said two cylindrical halves 40 and 45 partially enclose said locking means therein when the sleeve 10 is in the closed position.

Figure 3:
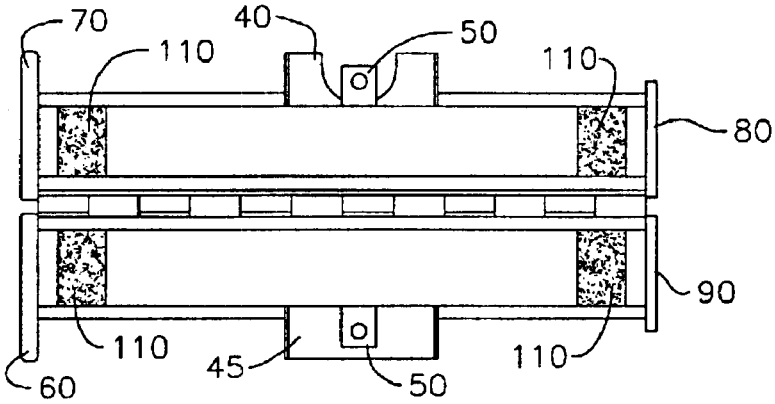
FIG. 3 is top view of the first embodiment in an open position.

Referring now to FIG. 3 of the drawings, sleeve halves 20 and 30 are pivotally connected along first opposing longitudinally extending meeting edges by hinge 100. Hinge 100 comprises several offset extensions 105 from each of said sleeve halves 20 and 30 that are alternatively integrated with a longitudinal hinge pin (not shown) positioned through an aperture in each of said extensions. A resilient pad 110 is disposed on the interior surface and proximate to both ends of each sleeve halves 20 and 30 to protect machinery from damage and to provide a more secure fit of the locking device 10 when in a closed position.

Figure 4:
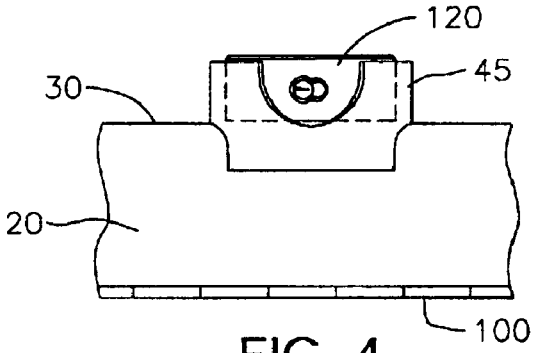
FIG. 4 is a detailed view of the cylindrical housing and locking means of the first embodiment.

In FIG. 4 of the drawings, locking means 120 secures the longitudinal extending meeting edges to one another via apertured lug 50. In the preferred embodiment, locking means 120 is a commercially available shackleless lock that includes a hardened steel cylindrical shell with a retractable locking pin that is only accessible from a lower side of locking means 120. Locking means 120 is lowered over lugs 50 within the cylindrical housing wherein locking means 120 includes a slotted recess on a lower side for receiving said lug 50. Lug 50 is slidingly received within the recess of locking means 120 wherein the cylindrical housing partially encloses the locking means wherein only the solid upper side of the locking means is exposed. The retractable locking pin is then manipulated to slide through the aperture of lug 50 using a unique key (not shown) and then locked into place using said key. The locking pin and lug are practically inaccessible to any unauthorized person. The locking means cannot be removed efficiently without the key.

Figure 5:
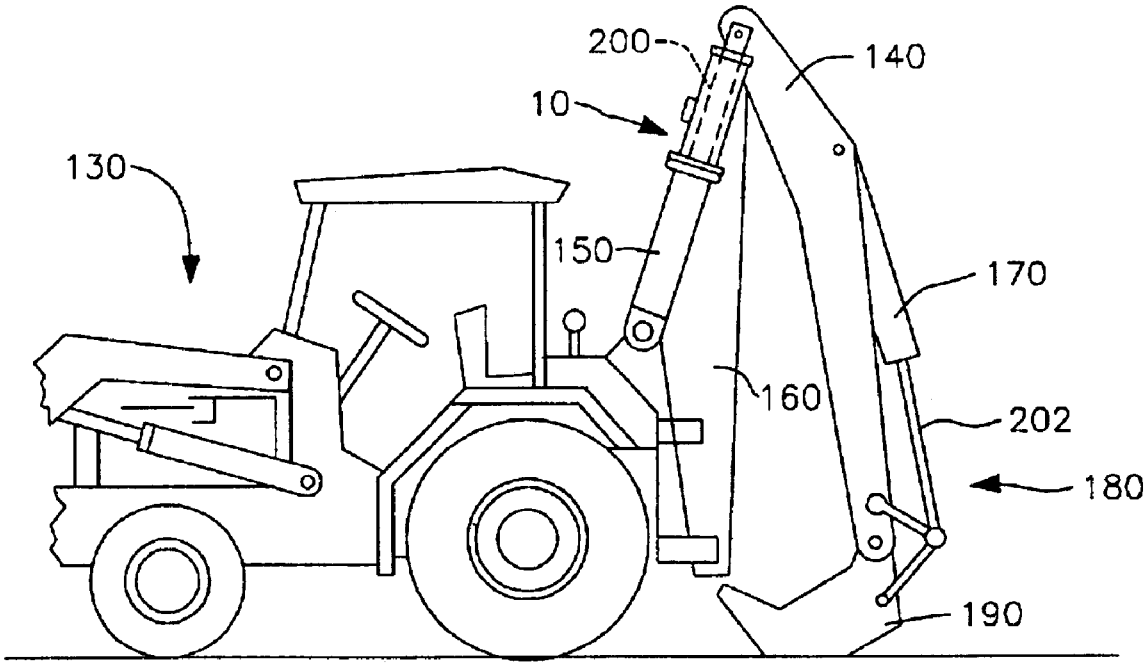
FIG. 5 is a side elevation of a backhoe equipped tractor and illustrating the first embodiment of the device.

Locking device 10 is shown in FIG. 5 of the drawings installed on a tractor 130 with a typical backhoe attachment 180. Backhoe attachment 180 includes a pair of booms 140 and 160 and a bucket 190 pivotally attached to one another. Boom 140 operates via corresponding hydraulic piston and cylinder assembly 150. Piston rod 200 of first boom 160 is shown in an extended position and device 10 is shown in a closed and locked position encircling rod 200. Annular flange (60 and 70) is in abutting relation to cylinder 150 and has a diameter greater than cylinder 150 wherein the opposing end of locking device 10 abuts boom 140. Thus, any hydraulic force generated by an attempt to retract the piston rod 200 within cylinder 150 when device 10 is installed is distributed to the outer cylinder wall thus decreasing the potential for damage to the mechanical capabilities of attachment 180 during a theft or vandalism attempt. It will thus be seen that with locking device 10 in place, boom 140 and bucket 190 cannot be raised from the ground and thereby prevents the tractor from being moved. A second locking device can be installed on hydraulic piston and cylinder assembly 170 if desired for additional security protection. However, placing locking device 10 solely on second piston rod 202 would not provide the desired security protection to prevent bucket 190 from being raised.

Figure 6:
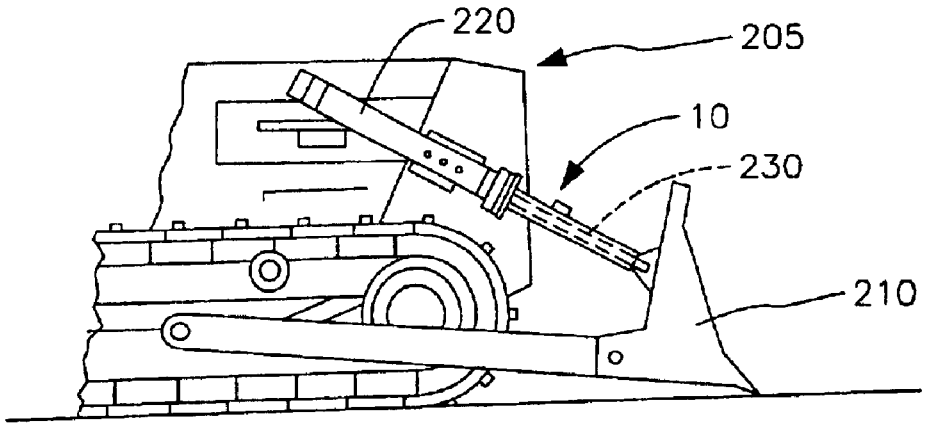
FIG. 6 is a side elevation of a portion of a bulldozer illustrating the first embodiment of the device.

In FIG. 6 of the drawings, a portion of a bulldozer 205 is shown having a blade attachment 210. Blade 210 is pivotally attached to bulldozer 205 and operates via a hydraulic piston and cylinder assembly 220. Piston rod 230 of cylinder 220 is in an extended position and device 10 is shown in a closed and locked position encircling rod 230. Annular flange (60 and 70) is in abutting relation to cylinder 220 and has a diameter greater than cylinder 220 wherein the opposing end of locking device 10 abuts blade 210. Similar to backhoe attachment 180 shown in FIG. 5, any hydraulic force generated by an attempt to retract the piston rod 230 within cylinder 220 is distributed to the outer cylinder wall thus decreasing the potential for damage to the mechanical capabilities of blade 210 during a theft or vandalism attempt. It will thus be seen that with locking device 10 in place, blade 210 cannot be raised from the ground and thereby prevents bulldozer 205 from being moved.

Figure 7:
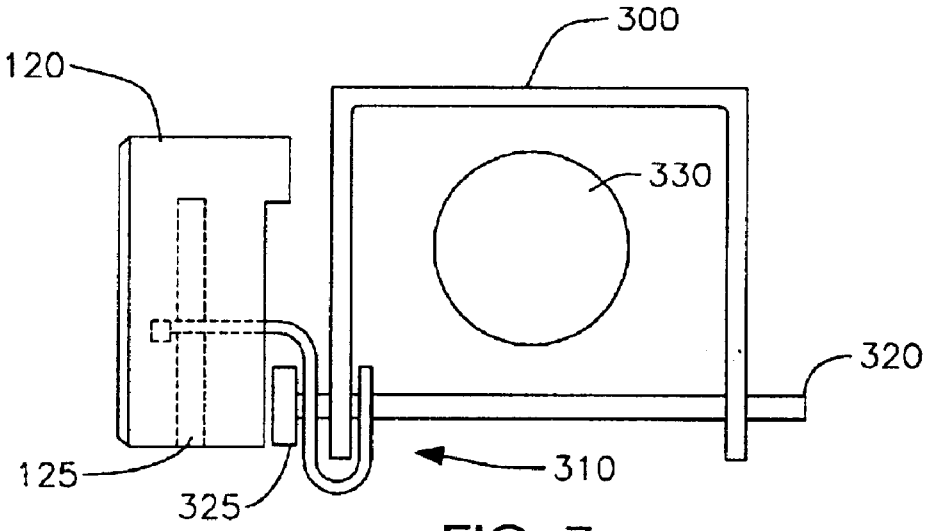
FIG. 7 is a cross sectional view of a piston rod and sleeve half illustrating the second embodiment of the device.

Referring now to FIG. 7, a second embodiment of the locking device is illustrated by sleeve half 300 mounted and partially encircling piston rod 330. Bolt 320 passes through a pair of apertures disposed on the transversely spaced sidewalls of sleeve 330 and through a pair of aligned apertures located on bracket 310. Head 325 of bolt 320 has a diameter greater than aperture diameters of bracket 310 thus securing bolt 320 within the apertures. Locking means 120 is identical to the locking means of the above described first embodiment. The inner side of lock 120 has a recess 327 that allows the projecting flange of bracket 310 to be inserted therein. An aperture located in the top flange of bracket 310 allows locking pin 125 to be placed therethrough. A key.(not shown) secures locking pin 125 into a locked position so that bracket 310 cannot be removed from lock 120, thus preventing bracket 310 from being removed from sleeve 300. With bracket 310 securely in place, bolt 320 cannot be removed from bracket 310 thereby preventing sleeve 300 from being removed by unauthorized means from around piston rod 330. Sleeve 300 is mounted in similar fashion as the first embodiment with a first end in abutting relation to a hydraulic cylinder wherein the opposing end of sleeve 300 abuts a bearing point. The novel bracket 310 and bolt 320 assembly used in conjunction with locking means 120 is suitable to be used with standard sleeves known in the industry as safety devices commonly used during maintenance procedures and the like.

Figure 8:
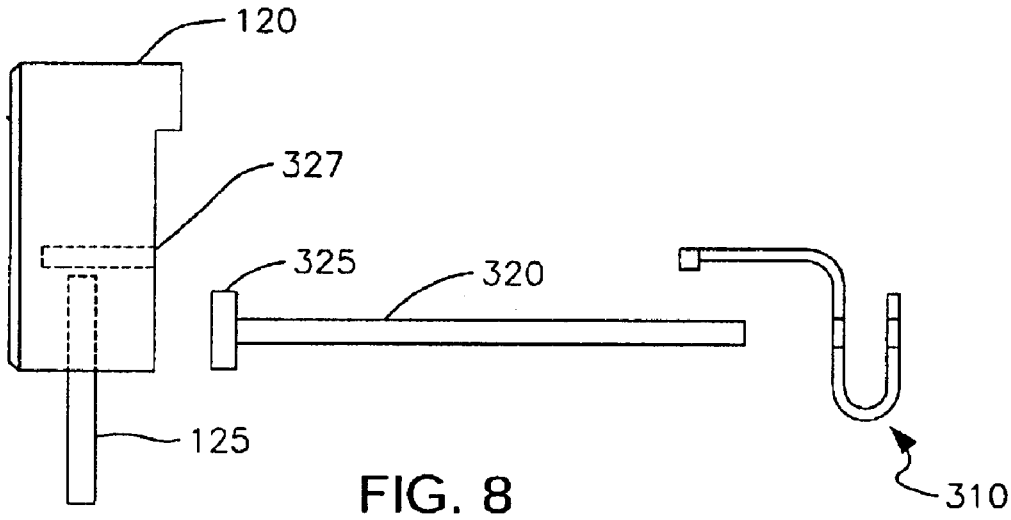
FIG. 8 is an exploded side view of the second embodiment.
Figure 9:
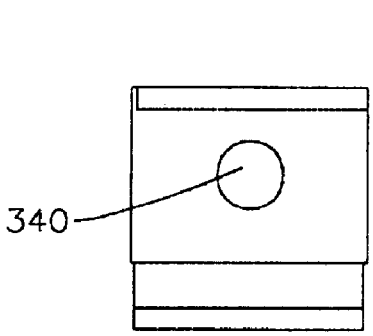
FIG. 9 is a top view of the novel bracket of the second embodiment.
Figure 10:
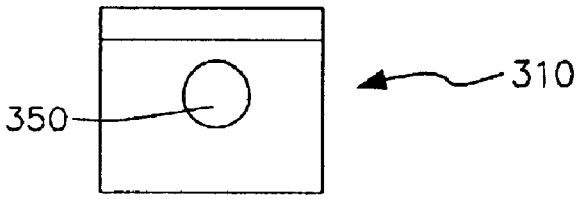
FIG. 10 is front view of the novel bracket of the second embodiment.

In FIG. 8, locking means 120 is shown with locking pin 125 withdrawn. Recess 327 is shown without top flange of bracket 310 inserted. FIG. 9 is a top view of bracket 310 showing locking pin aperture 340. Top aperture 340 provides the means to secure bracket 310 via locking pin 125 within locking means 120. FIG. 10 is a front view of bracket 310 showing a first front aperture 350 thereby providing a means to place bolt 320 therethrough. A second aperture (not shown) is aligned and cooperates with front aperture 350 to secure bolt 320 on either side of a sidewall of sleeve 300.

The locking device can be installed without undue effort and thus is easily installed and removed as desired. The locking device is durable and can withstand unauthorized removal attempts and is suitable for any heavy machine with a like hydraulic piston and cylinder assembly. Additionally, the locking device can be manufactured to any desired length or diameter to fit any piston and cylinder assembly that may be different in magnitude of size.

It is also to be understood that the following claims are intended to cover all of the generic and specific features of the invention herein described, and all statements of the scope of the invention that, as a matter of language, might be said to fall therebetween.

Now that the invention has been described.

What is claimed is:

1. A locking device for use on hydraulic cylinder and piston assemblies comprising:

a substantially rigid sleeve consisting of a pair of sleeve halves having diametrically opposite longitudinally extending meeting edges wherein said sleeve halves are hingedly connected along a first meeting edge via a hinge means so that said sleeve halves are openable and adaptable for mounting on an extended piston rod;

a locking means between said sleeve halves at a second opposing longitudinal extending meeting edge for releasably securing said sleeve halves to one another wherein said sleeve is adapted to fit snugly around said piston rod in encircling relation thereto;

a half circle portion of an annular flange is disposed on a first end of each of said sleeve halves wherein the diameter of said annular flange is greater than the diameter of a cylinder of said hydraulic cylinder and piston assembly;

a half portion of a lock protecting housing is disposed adjacently and in mirrored relation on each of said pair of sleeve halves so that a locking means can be enclosed therein when said sleeve is mounted on said piston rod;

an apertured lug extending from and secured to each of said sleeve halves within said lock protecting housing wherein each said lug is apertured for receiving a locking pin therethrough and said locking pin is releasably secured using said key; and an overlying reinforcing band is disposed proximate to a second end of each of said sleeve halves so that stress loads concentrated at said second end are dissipated.

2. The locking device of claim 1 wherein said locking means is a shackleless lock comprising a hardened steel cylindrical shell with a retractable locking pin so that as said lock is mounted within said lock protecting housing said lock protecting housing partially encloses said lock so that only a solid upper side of said lock is exposed.

3. The locking device of claim 1 wherein said hinge means comprises a plurality of adjacent offset extensions disposed along said first meeting edge of said sleeve halves wherein said extensions are in meshing linear orientation and said hinge means further comprises a longitudinal hinge pin positioned concentrically through an aperture of each said extension thereby hingedly securing said sleeve halves about said first meeting edge.

4. The locking device of claim 1 further comprising a pair of resilient pads each said pad proximate to an opposing end of each said sleeve halves and disposed on an interior surface thereon whereby said piston rod is protected from damage and said locking device fits snugly around said piston rod.

5. A locking device for use on hydraulic cylinder and piston assemblies comprising:

a substantially rigid sleeve consisting of a pair of sleeve halves having diametrically opposite longitudinally extending meeting edges wherein said sleeve halves are hingedly connected along a first meeting edge via a hinge means so that said sleeve halves are openable for mounting on an extended piston rod wherein said hinge means comprises a plurality of adjacent offset extensions disposed along said first meeting edge of said sleeve halves wherein said extensions are in meshing linear orientation and said hinge means further comprises a longitudinal hinge pin positioned concentrically through an aperture of each of said extension thereby hingedly securing said sleeve halves about said first meeting edge;

a locking means between said sleeve halves at a second opposing longitudinal extending meeting edge for releasably securing said sleeve halves to one another wherein said sleeve is adapted to fit snugly around said piston rod in encircling relation thereto wherein said locking means is a shackleless lock comprising a hardened steel cylindrical shell with a retractable locking pin so that said cylindrical housing partially encloses said lock so that only a solid upper side of said lock is exposed;

an apertured lug extending from and secured to each of said sleeve halves within said cylindrical housing wherein each said lug is apertured for receiving a locking pin therethrough and is releasably secured using said key;

a half circle portion of an annular flange is disposed on a first end of each of said sleeve halves wherein the diameter of said annular flange is greater than the diameter of a cylinder of said hydraulic cylinder and piston assembly;

a half portion of a lock protecting housing is disposed adjacently and in mirrored relation on each of said pair of sleeve halves so that a locking means can be enclosed therein when said sleeve is mounted on said piston rod;

an overlying reinforcing band is disposed proximate to a second end of each of said sleeve halves so that stress loads concentrated at said second end are dissipated; and a pair of rectangular resilient pads each said pad proximate to an opposing end of each said sleeve halves and disposed on an interior surface thereon whereby said piston rod is protected from damage and said locking device fits snugly around said piston rod.

6. A locking device for use on hydraulic cylinder and piston assemblies comprising:

a bracket comprising a retaining slot dimensioned to receive therein a sidewall of a substantially rigid U-shaped sleeve wherein said sleeve includes transversely spaced sidewalls, said sleeve further comprises a first aperture and a second aperture disposed on said sidewalls in linear alignment;

said retaining slot defined by an inner wall of said slot and an outer wall of said slot facing thereto and sandwiching said sidewall therebetween;

said bracket further comprises a top projecting flange and a top aperture located thereon wherein said bracket further comprises inner and outer apertures disposed respectively in linear alignment on said inner and outer walls of said slot;

a locking bolt received respectively therein by said outer aperture, said first aperture, said inner aperture, and said second aperture thereby securing said sleeve to said piston rod via said bracket cooperating with said locking bolt; and a locking means comprising a hardened steel cylindrical shell with a retractable locking pin wherein an inner side of said locking means has a recess that allows said projecting top flange of bracket to be inserted therein wherein a key secures locking pin into a locked position so that said bracket cannot be removed from said sleeve.

* * * * *